US005526929A

United States Patent [19]

Wei

[11] Patent Number: 5,526,929

[45] Date of Patent: Jun. 18, 1996

[54] TOOL BOX WITH A COVER, A BASE AND A PLATE DISPOSED BETWEEN THE COVER AND THE BASE

[76] Inventor: Yong L. Wei, 2F, 903, Shiang Sin South Road, Taichung, Taiwan

[21] Appl. No.: 413,272

[22] Filed: Mar. 30, 1995

[51] Int. Cl.[6] ..... B65D 85/28; B65D 6/16

[52] U.S. Cl. ..... 206/378; 206/372; 220/4.24

[58] Field of Search ..... 206/372, 373, 206/376, 562, 564; 220/735, 528, 529, 533, 326, 4.21, 4.23, 4.24

[56] References Cited

U.S. PATENT DOCUMENTS

| | | | |
|---|---|---|---|
| 3,937,352 | 2/1976 | Kalous | 220/4.24 X |
| 4,340,140 | 7/1982 | Wilcox et al. | 206/373 |
| 5,004,103 | 4/1991 | Connors et al. | 206/372 |
| 5,111,362 | 5/1992 | Flamm et al. | 220/4.24 X |
| 5,173,273 | 12/1992 | Brewer | 206/562 X |
| 5,353,947 | 10/1994 | Zinnbauer et al. | 220/528 X |
| 5,398,810 | 3/1995 | Yao Wang | 206/372 X |

*Primary Examiner*—Paul T. Sewell
*Assistant Examiner*—BethAnne C. Dayoan

[57] ABSTRACT

A tool box includes a base, a plate and a cover which is pivotally engaged to the base, the base has four side walls and a bottom from which a plurality of studs extending therefrom, each stud having a hole defined in a top thereof, the base having two opposite side walls each having a groove defined in an inner side thereof, the plate having a plurality of recesses defined therein and having a plurality of pin elements extending downwardly from an under side thereof for engagement with the holes of the studs, the plate having an extending portion extending from a side corresponding to the groove of the base so as to be received in the corresponding groove.

3 Claims, 3 Drawing Sheets

FIG, 2

TOOL BOX WITH A COVER, A BASE AND A PLATE DISPOSED BETWEEN THE COVER AND THE BASE

BACKGROUND OF THE INVENTION

The present invention relates to a tool box and more particularly, to a tool box composed of a cover, a plate and a base.

FIG. 1 shows a conventional tool box which comprises a cover 40 and a base 50, the base 50 is substantially rectangular shape and has a receiving portion 501 formed to an upper surface thereof, the receiving portion 501 has a plurality of recesses 51, 52 defined in an upper surface thereof for receiving tools (figure not shown) therein. However, such a tool box has two defects, first one is that the base 50 is made one piece such that only one color can be chosen and secondly, the base 50 is made according to a die which has a complicated configuration and a large volume because the base 50 includes the receiving portion 501 and such a die to manufacture the base 50 requires a high expense.

The present invention intends to provide a tool box including a cover, a plate for receiving tools and a base, each of which has its own die and can be assembled together easily so as to mitigate and/or obviate the above-mentioned problems.

SUMMARY OF THE INVENTION

The present invention provides a tool box which includes a base, a plate and a cover which is pivotally engaged to the base, the base has four side walls and a bottom from which a plurality of studs extending therefrom, each stud having a hole defined in a top thereof, the base having two opposite side walls each having a groove defined in an inner side thereof, the plate having a plurality of recess defined therein and having a plurality of pin elements extending downwardly from an under side thereof for engagement with the holes of the studs, the plate having an extending portion extending from a side corresponding to the groove of the base so as to be received in the corresponding groove.

It is an object of the present invention to provide a tool box which has a replaceable plate having a plurality of recesses for receiving tools therein.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
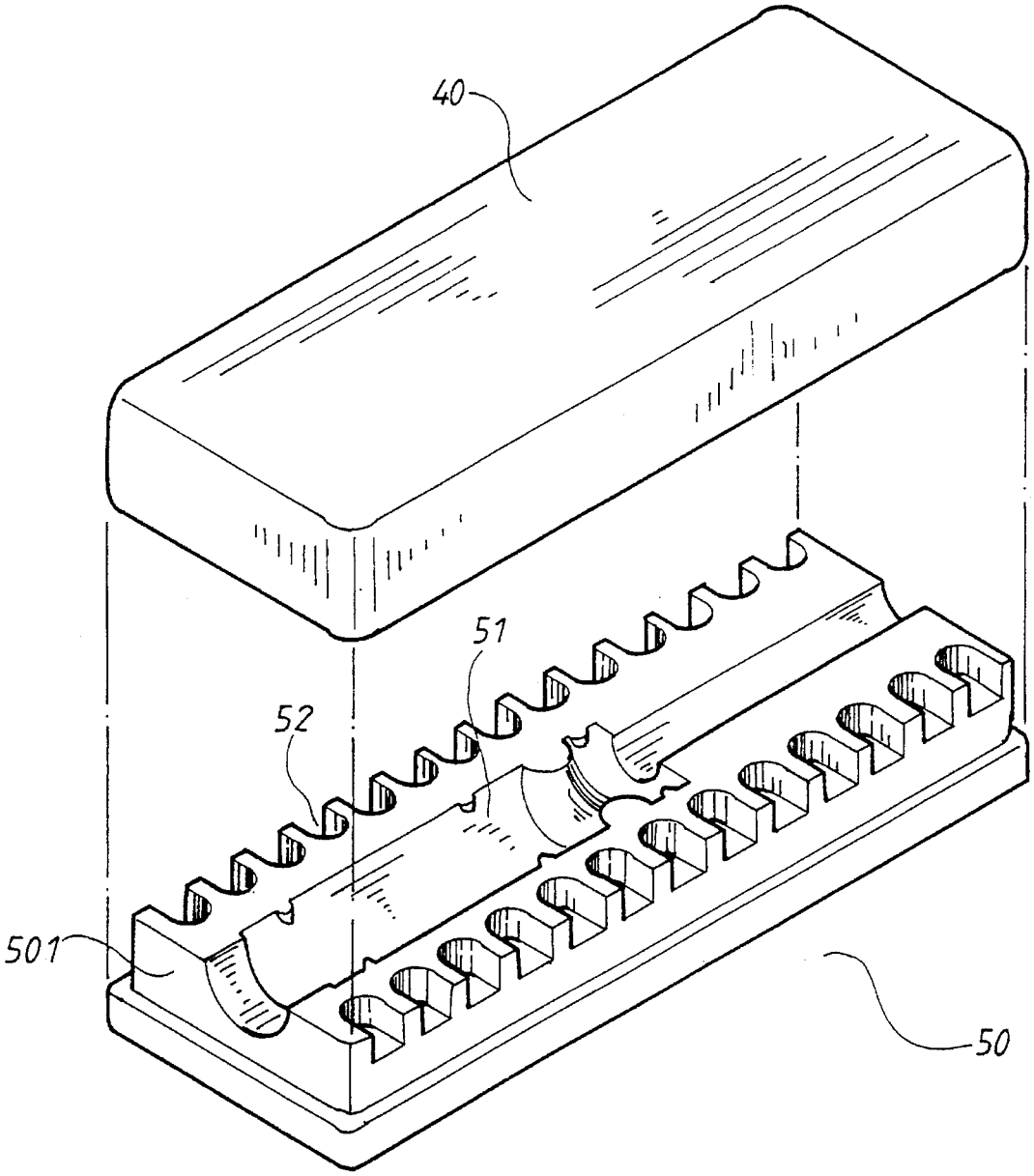
FIG. 1 PRIOR ART
FIG. 1 is an exploded view of a conventional tool box.
Figure 2:
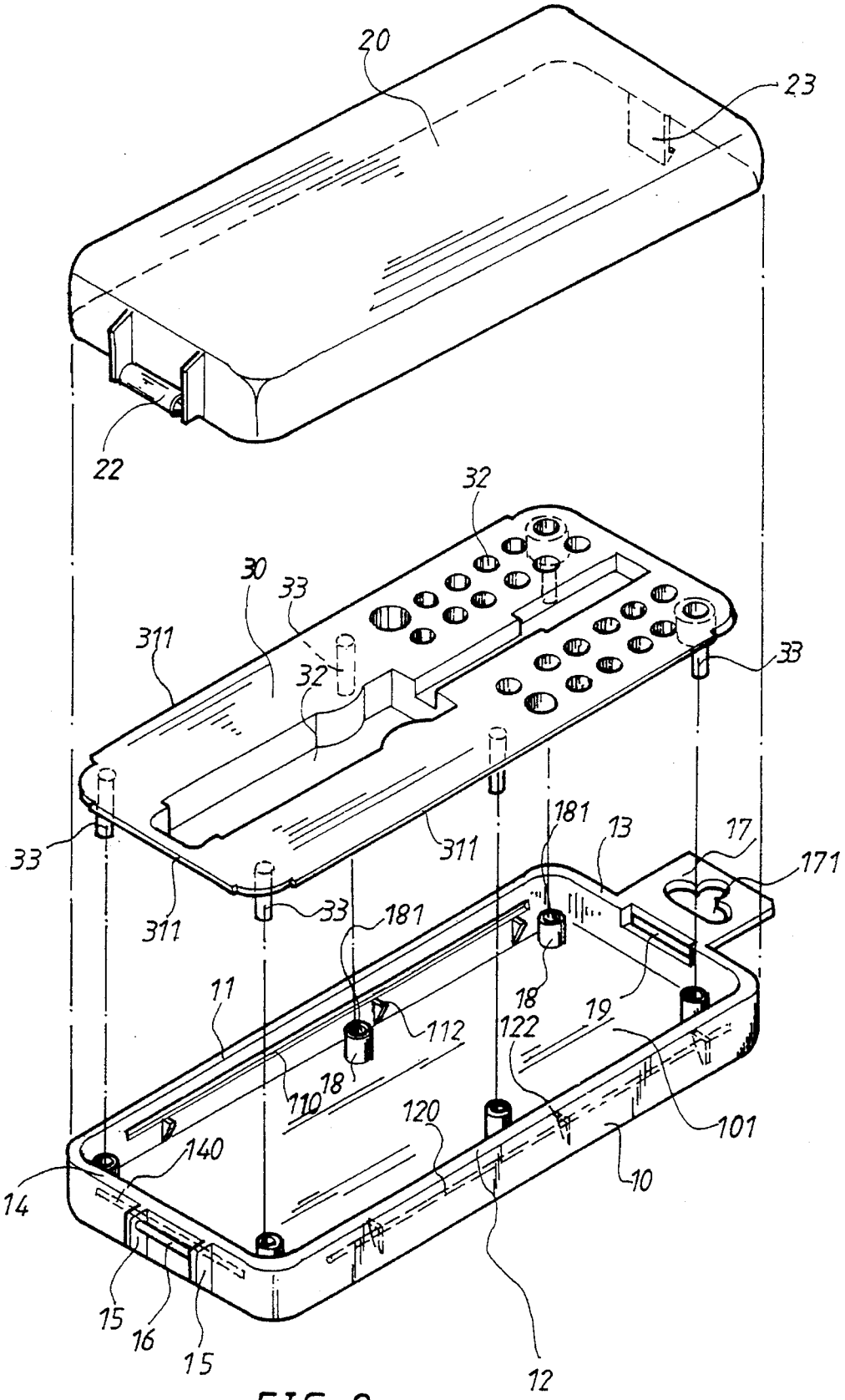
FIG. 2 is an exploded view of a tool box in accordance with the present invention.
Figure 3:
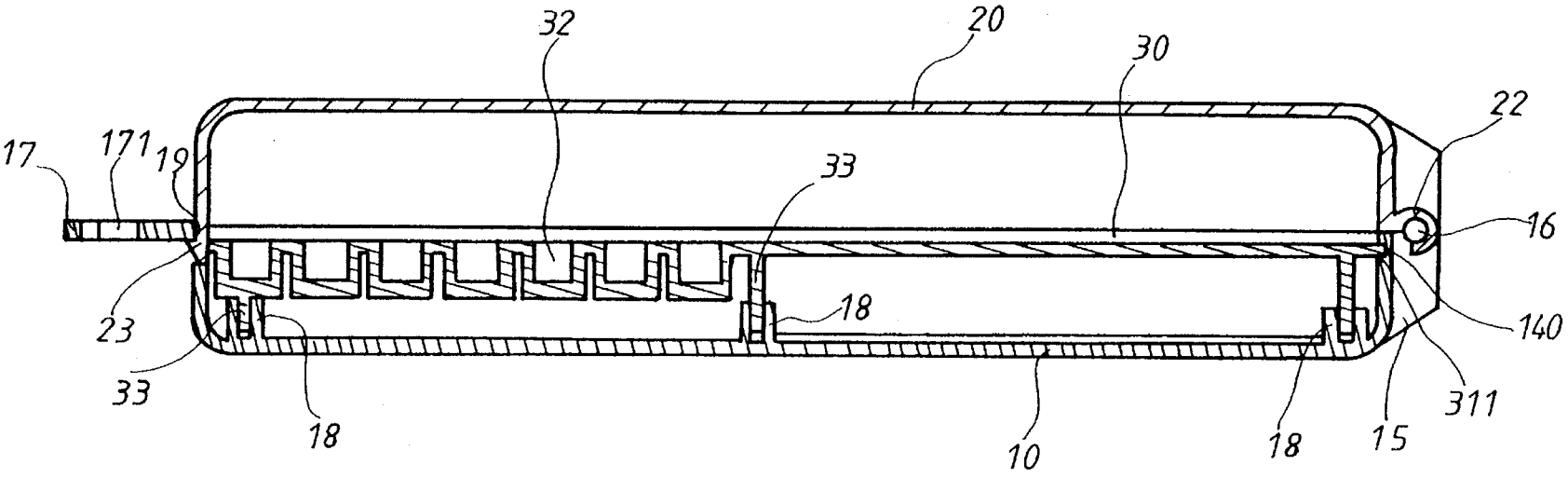
FIG. 3 is a side elevational view, partly in section, of the tool box in accordance with the present invention.

Referring to FIGS. 1 and 2, a tool box in accordance with the present invention generally includes a base 10, a plate 30 and a cover 20. The base 10 is substantially rectangular configuration and has a bottom 101 and a first wall 11, a second wall 12, a third wall 13 and a fourth wall 14, the first wall 11 and the second wall 12 extending upwardly from opposite sides of a periphery of the bottom 101, the first wall

11, the second wall 12 and the fourth wall 14 having a groove 110, 120, 140 respectively defined in an inner side thereof, the bottom 101 having six studs 18 extending upwardly therefrom and each stud 18 having a hole 181 defined in a top thereof, each of the first wall 11 and the second wall 12 having three protrusions 112, 122 extending laterally from the inner side thereof. The third wall 13 of the base 10 has an ear extending in a direction opposite to the fourth wall 14 from an upper edge thereof, a hole 171 is defined in the ear 17 such that the tool box is able to be hung on a suitable object and a recess 19 is defined in the upper edge of the third wall 13. The fourth wall 14 has two lugs 15 extending in a direction opposite to the third wall 13 and a rod 16 connected between the two lugs 15.

The plate 30 has a plurality of recesses 32 defined therein and having six pin elements 33 extending downwardly from an under side thereof to be inserted into the holes 181 of the studs 18 corresponding thereto, an extending portion 311 extending from three sides of the plate 30 for engagement with the grooves 110, 120 and 140 corresponding thereto such that the plate 30 is fixedly engaged to the base 10 by inserting the pin elements 33 into the holes 181 of the studs 18, receiving the extending portions 311 in the respective grooves 110, 120, 140 and mounting the plate 30 supported on the six protrusions 112, 122.

The cover 20 has a first end and a second end, the first end thereof having a hook element 23 extending downwardly therefrom and the second end thereof having a C-shaped clipper 22 disposed thereto, such that the hook element 23 ban be engaged to an under side of the ear 17 via the recess 19 and the rod 16 is received in the C-shaped clipper 22 of the cover 20 such that the cover 20 is pivotally engaged to the base 10 and is pivoted about an axis of the rod 16 by disengaging the hook element 23 from the recess 19.

Accordingly, the present invention provides a tool box which is easy to be assembled and the plate 30 for receiving tools therein is replaceable and further, each of the cover 20, the plate 30 and the base 10 has a simple configuration such that the expense of making the die of the three elements can be reduced.

Although the invention has been explained in relation to its preferred embodiment, it is to be understood that many other possible modifications and variations can be made without departing from the spirit and scope of the invention as hereinafter claimed.

I claim:

1. A tool box comprising:

a base having a bottom and a first wall, a second wall a third wall and a fourth wall, said first wall and said second wall extending upwardly from opposite sides of a periphery of said bottom, each of said first and said second walls having a groove defined in an inner side thereof, said bottom having a plurality of studs extending upwardly therefrom, each of said studs having a hole defined in a top thereof;

a plate, said plate having a plurality of recesses defined therein and having a plurality of pin elements each extending downwardly from an under side thereof for inserting into said holes of said studs corresponding thereto, an extending portion extending from two opposite sides thereof for engaged in said grooves corresponding thereto, and a cover, said cover having a first end and a second end, said first end thereof having a hook element extending downwardly therefrom and said second end thereof having a C-shaped clipper disposed thereto, said third wall of said base having an ear extending from an upper edge thereof in a direction opposite to said fourth wall and a recess defined in said upper edge of said third wall, said fourth wall having two lugs extending in a direction opposite to said third wall and a rod connected between said two lugs such that the hook element engaged to an under side of said ear via said recess defined in said third wall and said rod received in said C-shaped clipper of said cover.

2. The tool box as claimed in claim 1 wherein said fourth wall has a groove defined in an inner side thereof and a side corresponding to said fourth wall of said plate having a extending portion extending therefrom to be received in said groove.

3. The tool box as claimed in claim 1 wherein each of said first wall and said second wall has a plurality of protrusions extending form an inner side thereof and located below said groove.

* * * * *